US008426776B2

(12) United States Patent
Wang et al.

(10) Patent No.: US 8,426,776 B2
(45) Date of Patent: Apr. 23, 2013

(54) CARBON NANOTUBE DEFROST WINDOWS

(75) Inventors: Yu-Quan Wang, Beijing (CN); Liang Liu, Beijing (CN)

(73) Assignee: Beijing FUNATE Innovation Technology Co., Ltd., Beijing (CN)

( * ) Notice: Subject to any disclaimer, the term of this patent is extended or adjusted under 35 U.S.C. 154(b) by 231 days.

(21) Appl. No.: 12/806,499

(22) Filed: Aug. 13, 2010

(65) Prior Publication Data

US 2011/0155713 A1 Jun. 30, 2011

(30) Foreign Application Priority Data

Dec. 29, 2009 (CN) ..... 2009 1 0265337

(51) Int. Cl.
*H05B 3/84* (2006.01)

(52) U.S. Cl.
USPC ..... 219/203; 219/522; 219/544; 219/547; 977/742; 977/778; 977/783

(58) Field of Classification Search ..... 219/202, 219/203, 522, 544, 546–547; 977/742, 778, 977/783
See application file for complete search history.

(56) References Cited

U.S. PATENT DOCUMENTS

| | | | | |
|---|---|---|---|---|
| 8,153,940 | B2 * | 4/2012 | Niemz et al. | 219/544 |
| 2005/0083577 | A1 * | 4/2005 | Varaprasad et al. | 359/604 |
| 2007/0056947 | A1 * | 3/2007 | Damian | 219/203 |
| 2008/0203079 | A1 * | 8/2008 | Veerasamy et al. | 219/203 |
| 2009/0140098 | A1 * | 6/2009 | Lengsfeld et al. | 244/121 |
| 2009/0320911 | A1 * | 12/2009 | Ruoff | 136/252 |
| 2009/0321418 | A1 * | 12/2009 | Feng et al. | 219/546 |
| 2010/0126985 | A1 * | 5/2010 | Feng et al. | 219/553 |
| 2010/0237055 | A1 * | 9/2010 | Rousseau et al. | 219/203 |
| 2011/0204330 | A1 * | 8/2011 | LeMieux et al. | 257/15 |

* cited by examiner

*Primary Examiner* — Allan R Wilson
(74) *Attorney, Agent, or Firm* — Altis Law Group, Inc.

(57) ABSTRACT

A defrost window includes a transparent substrate, a carbon nanotube film, a first electrode, a second electrode and a protective layer. The transparent substrate has a top surface. The carbon nanotube film is disposed on the top surface of the transparent substrate. The first electrode and the second electrode electrically connect to the carbon nanotube film and space from each other. The protective layer covers the carbon nanotube film.

7 Claims, 8 Drawing Sheets

CARBON NANOTUBE DEFROST WINDOWS

This application claims all benefits accruing under 35 U.S.C. §119 from China Patent Application No. 200910265337.4, filed on 2009 Dec. 29, in the China Intellectual Property Office, incorporated herein by reference.

BACKGROUND

1. Technical Field

The present disclosure relates to defrosting windows and vehicles using the same, particularly, to a defrosting window based on carbon nanotubes and a vehicle using the same.

2. Description of Related Art

Good visibility through the windows of a vehicle is critical for safe driving. In the morning of winter days, the windows of the vehicles often have a thin layer of frost. The frost on the windows could badly affect the driver's visibility. Therefore, it is necessary to scrape the frost off the windows of the vehicle before driving.

To get rid of the frost on the windows of the vehicles, a conductive paste of metal powder is coated on the windows to form a conductive layer. A voltage is applied to the conductive layer to generates heat and melt the frost. However, the conductive layer is not a whole structure formed on the surface of the vehicle windows. Thus, the conductive layer can shed from the vehicle windows, which will badly affect the defrosting process.

What is needed, therefore, is a defrost window with good defrosting effect, and a vehicle using the same.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
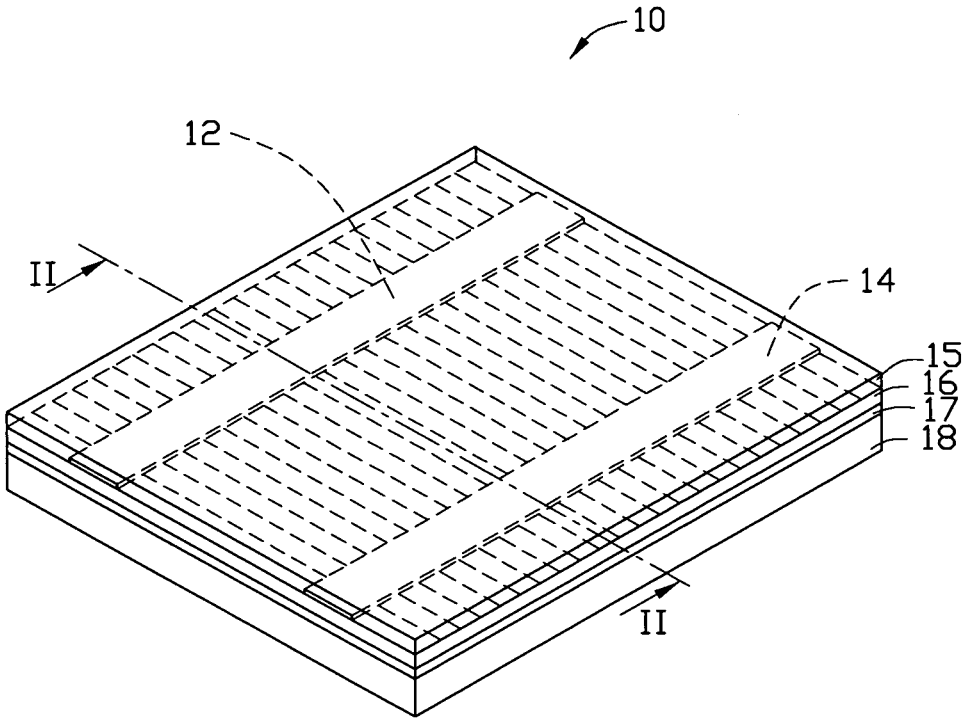
FIG. 1 is a schematic view of an embodiment of a defrost window.
Figure 2:
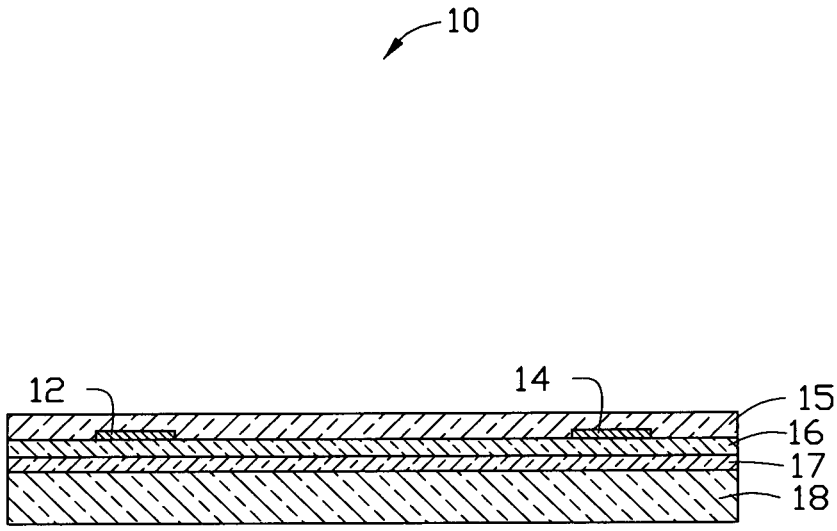
FIG. 2 is a cross-sectional view taken along a line II-II of the defrost window shown in FIG. 1.

Referring to FIG. 1 and FIG. 2, one embodiment of a defrost window 10 includes a transparent substrate 18, an adhesive layer 17, a carbon nanotube film 16, a first electrode 12, a second electrode 14, and a protective layer 15. The adhesive layer 17 can be located on a top surface of the transparent substrate 18 and a bottom surface of the carbon nanotube film 16, to adhere the carbon nanotube film 16 to the transparent substrate 18. The first electrode 12 and the second electrode 14 are electrically connected to the carbon nanotube film 16 and spaced from each other a certain distance. The protective layer 15 is disposed on a top surface of the carbon nanotube film 16 and covers the carbon nanotube film 16, the first electrode 12, and the second electrode 14.

The transparent substrate 18 can have a curved structure or a planar structure and functions as a supporter with suitable transparency. The transparent substrate 18 may be made of a rigid material, such as glass, silicon, diamond, or plastic. The shape and size of the transparent substrate 18 is not limited, and can be determined according to need. For example, the transparent substrate 18 may be square, round, or triangular. In one embodiment, the transparent substrate 18 is a square sheet about 1 centimeter thick, and made of glass.

The adhesive layer 17 can be formed on the top surface of the transparent substrate 18 by a screen-printing method. The adhesive layer 17 may be a thermoplastic adhesive or ultraviolet rays adhesive, such as polyvinyl polychloride (PVC) or polymethyl methacrylate acrylic (PMMA). A thickness of the adhesive layer 17 can be selected according to need, so long as the adhesive layer 17 can fix the carbon nanotube film 16 on the transparent substrate 18. The thickness of the adhesive layer 17 is in a range from about 1 nanometer to about 500 μm. In one embodiment, the thickness of the adhesive layer 17 is in a range from about 1 μm to about 2 μm. In one embodiment, the adhesive layer 17 is made of PMMA, and the thickness of the adhesive layer 17 is about 1.5 μm.

The carbon nanotube film 16 can be a free-standing structure, meaning that the carbon nanotube film 16 can be supported by itself without a substrate for support. For example, if a point of the carbon nanotube film 16 is held, the entire carbon nanotube film 16 can be supported from that point without damage. The carbon nanotube film 16 includes a plurality of carbon nanotubes combined end to end by Van der Waals attractive force therebetween, and oriented along a same direction. The carbon nanotube film 16 can be a substantially pure structure consisting of the carbon nanotubes with few impurities and is transparent. The carbon nanotube film 16 can be fixed on the top surface of the transparent substrate 18 firmly because the carbon nanotubes of the carbon nanotube film 16 combined end to end by Van der Waals attractive force have good adhesion. The carbon nanotube film 16 is a whole structure, which means that the carbon nanotubes of the carbon nanotube film 16 are connected to each other, and form a free-standing structure, thus it is not easy to shed from the transparent substrate 18.

In one embodiment, the entire carbon nanotube film 16 is attached on the top surface of the transparent substrate 18 via the adhesive layer 17. In other embodiments, the carbon nanotube film 16 includes a number of micropores, and the adhesive layer 17 is permeated in the micropores of the carbon nanotube film 16.

Figure 3:
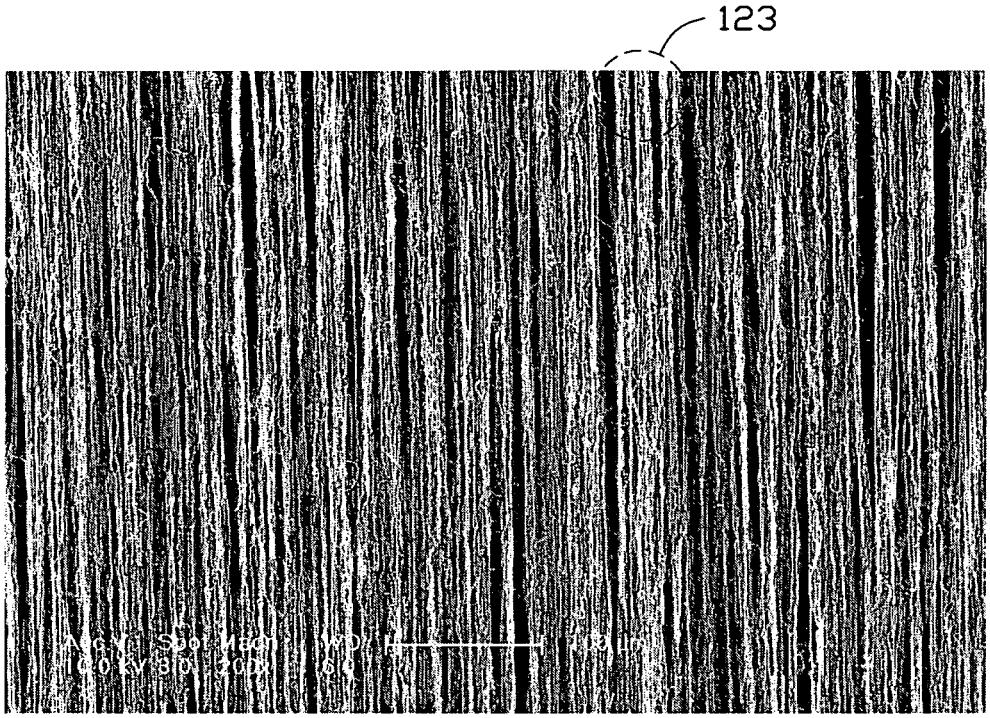
FIG. 3 is a Scanning Electron Microscope (SEM) image of a carbon nanotube film used in the defrost window of FIG. 1.
Figure 4:
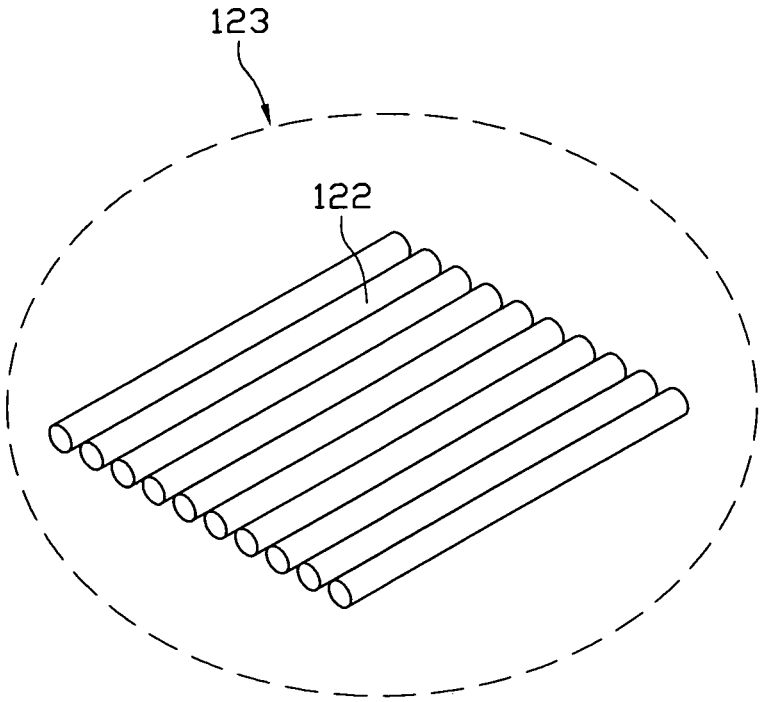
FIG. 4 is a schematic view of a carbon nanotube segment in the carbon nanotube film of FIG. 3.

Referring to FIG. 3 and FIG. 4, the carbon nanotube film 16 includes a plurality of successively oriented carbon nanotube segments 123 joined end-to-end by Van der Waals attractive force therebetween. Each carbon nanotube segment 123 includes a plurality of carbon nanotubes 122 substantially parallel to each other, and combined by Van der Waals attractive force therebetween.

The heat capacity per unit area of the carbon nanotube film 16 can be less than about $2\times10^{-4}$ J/m$^2$*K. Typically, the heat capacity per unit area of the carbon nanotube film 16 is less than or equal to about $1.7\times10^{-6}$ J/m$^2$*K. Because the heat capacity of the carbon nanotube film 16 is very low, and the temperature of the carbon nanotube film 16 can rise and fall quickly, the carbon nanotube film 16 has a high heating efficiency and accuracy. Furthermore, because the carbon nanotube film 16 can be substantially pure, the carbon nanotubes do not oxidize easily and the life of the carbon nanotube film 16 will be relatively long. The carbon nanotubes also have a low density, for example, about 1.35 g/cm$^3$, so the carbon nanotube film 16 is light. Because the heat capacity of the carbon nanotube film 16 is very low, the carbon nanotube film 16 has a high response heating speed. The carbon nanotubes have a large specific surface area. Accordingly, the carbon nanotube film 16 with a plurality of carbon nanotubes has, large specific surface area. If the specific surface of the carbon nanotube structure is large enough, the carbon nanotube film 16 is adhesive and can be directly applied to the top surface of the transparent substrate 18 without the adhesive layer 17.

The first electrode 12 and the second electrode 14 should have good conductive properties. The first electrode 12 and the second electrode 14 can be conductive films, metal sheets, or metal lines, and can be made of pure metals, metal alloys, indium tin oxide (ITO), antimony tin oxide (ATO), silver paste, conductive polymer, and metallic carbon nanotubes, and combinations thereof. The pure metals and metal alloys can be aluminum, copper, tungsten, molybdenum, gold, cesium, palladium, or combinations thereof. The shape of the first electrode 12 or the second electrode 14 is not limited and can be for example, lamellar, rod, wire, or block shaped. In the embodiment shown in FIG. 1, the first electrode 12 and the second electrode 14 are made of ITO, and are both lamellar and substantially parallel with each other. The carbon nanotubes in the carbon nanotube film 16 are aligned along a direction substantially perpendicular to the first electrode 12 and the second electrode 14.

The first electrode 12 and the second electrode 14 can be disposed on a same surface or opposite surfaces of the carbon nanotube film 16. It is imperative that the first electrode 12 can be separated from the second electrode 14 to prevent a short circuit of the electrodes. The first electrode 12 and the second electrode 14 can be electrically attached to the carbon nanotube film 16 by a conductive adhesive (not shown), such as silver adhesive. In some embodiments, the first electrode 12 and the second electrode 14 can be adhered directly to the carbon nanotube film 16 because some carbon nanotube films 16 have a large specific surface area and are adhesive in nature.

The protective layer 15 covers and protects the carbon nanotube film 16, the first electrode 12, and the second electrode 14. The protective layer 15 is made of a transparent polymer. The protective layer 15 can be made of polycarbonate (PC), PMMA, polyethylene terephthalate (PET), polyether polysulfones (PES), PVC, benzocyclobutenes (BCB), polyesters, acrylic resins, or epoxy resin. The thickness of the protective layer 15 is not limited, and can be selected according to the need. In one embodiment, the transparent substrate 18 is made of epoxy resin with a thickness about 200 micrometers.

It is to be understood that the defrost window 10 can include a number of carbon nanotube films 16 stacked one on top of another on the top surface of the transparent substrate 18. Additionally, if the carbon nanotubes in the carbon nanotube film 16 are aligned along one of the preferred orientations (e.g., the drawn carbon nanotube film). An angle can exist between the orientations of the carbon nanotubes in adjacent films, whether stacked or adjacent. Adjacent carbon nanotube films 16 can be combined by the Van der Waals attractive force therebetween. The carbon nanotubes of at least one carbon nanotube film 16 are oriented along a direction from the first electrode 12 to the second electrode 14.

Figure 5:
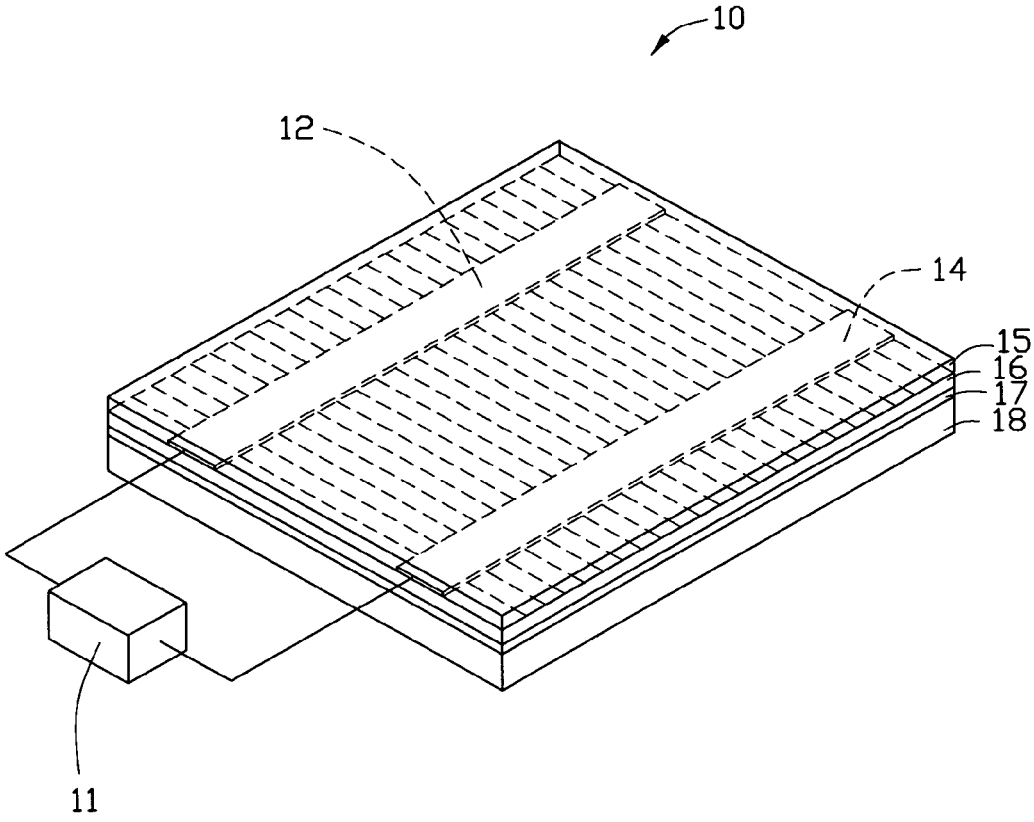
FIG. 5 is schematic view of an embodiment of a defrost window in operation.

Referring to FIG. 5, in use, when a voltage of an electrical source 11 is applied to the carbon nanotube film 16 via the first electrode 12 and the second electrode 14, the carbon nanotube film 16 radiates heat at a certain wavelength. Therefore, the heat is transmitted to the transparent substrate 18. The frost on the defrost windows 10 melts because of the heat through the transparent substrate 18.

Figure 6:
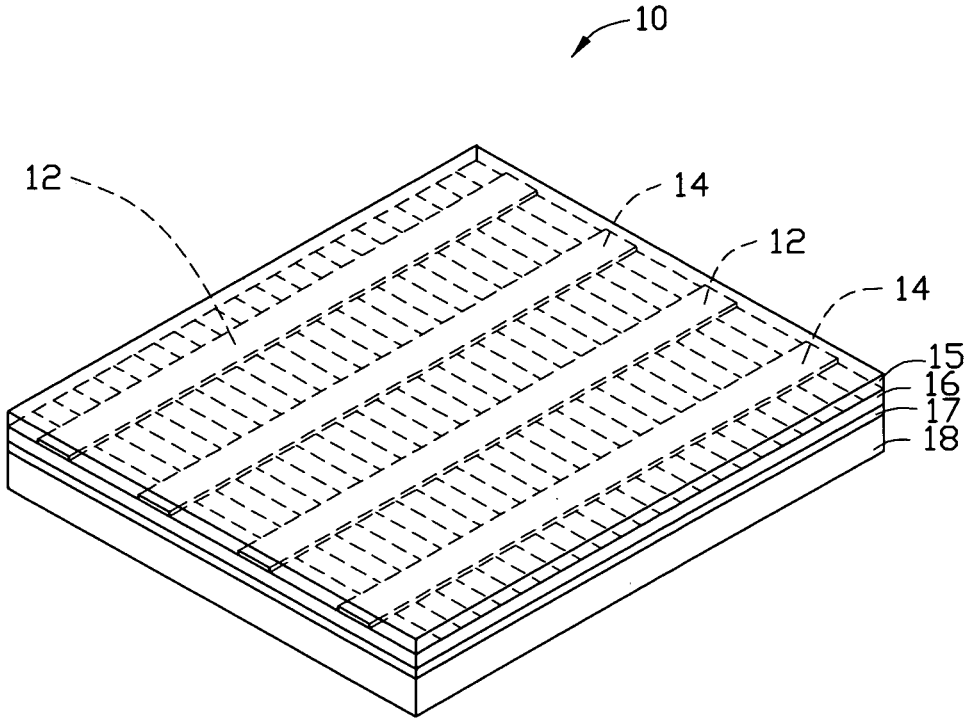
FIG. 6 is a schematic view of another embodiment of a defrost window.

Referring to FIG. 6, in one embodiment, the defrost window 10 can include a plurality of alternatively arranged first and second electrodes 12 and 14. The first electrodes 12 and the second electrodes 14 can be arranged in a staggered manner, for example, side by side as shown in FIG. 6. All of the first electrodes 12 are electrically connected together, and all of the second electrodes 14 are electrically connected together. A voltage is applied on the carbon nanotube film 16 from the first electrodes 12 to the second electrodes 14.

Figure 7:
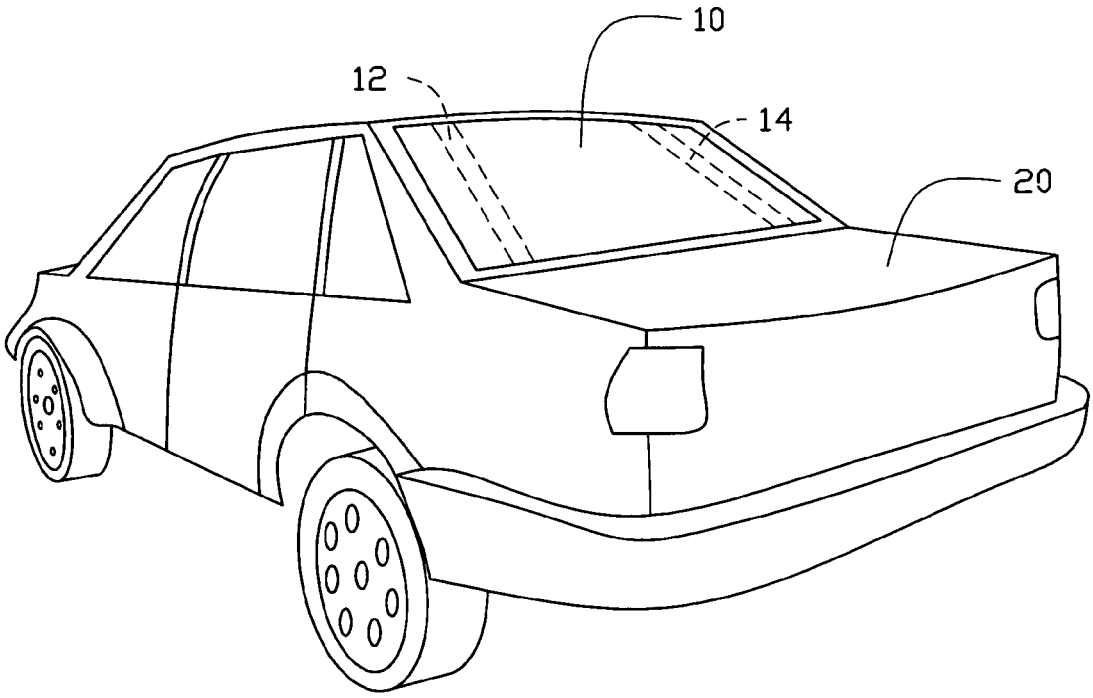
FIG. 7 is a schematic view of one embodiment of a vehicle with the defrost window of FIG. 1.

Referring to FIG. 7, one embodiment of a vehicle 20 with a defrost window 10 is provided. The defrost window 10 is used as the back window of the vehicle 20. The carbon nanotube film 15 of the defrost window faces inside the vehicle 20. The first electrode 12 and the second electrode 14 are electrically connected to an electrical source system of the vehicle 20. The defrost window 10 can also be used as the front or side windows of the vehicle 20, because the defrost window 10 is transparent.

Figure 8:
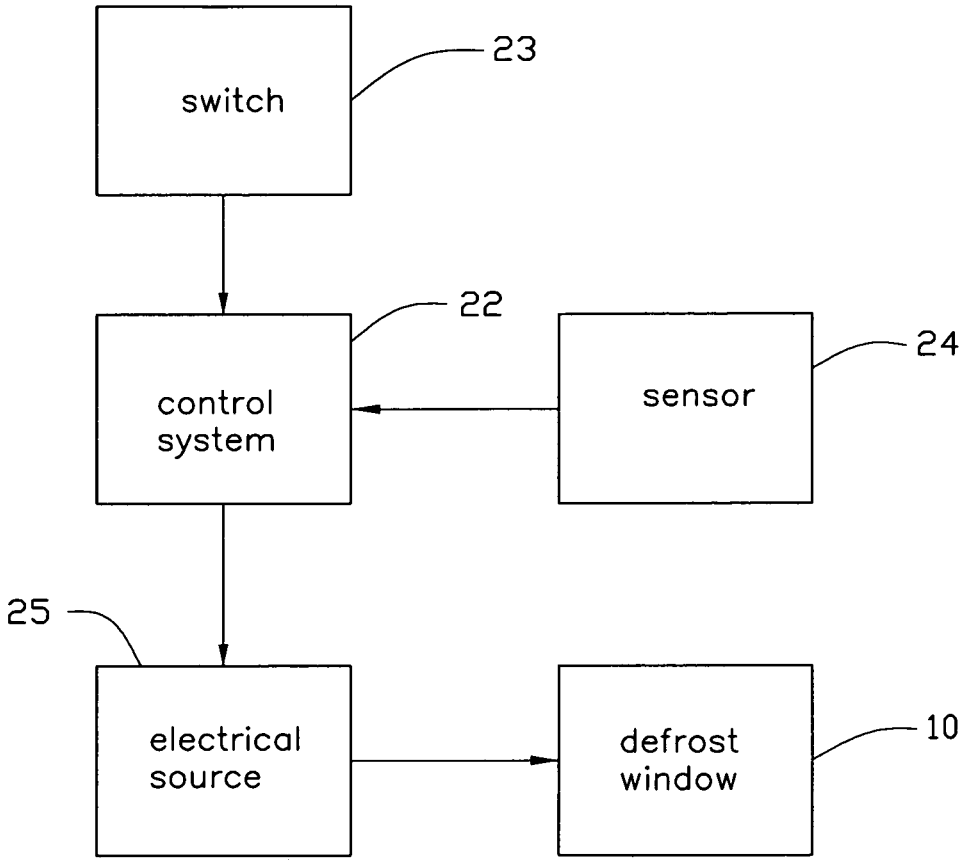
FIG. 8 is a schematic view of one embodiment of a defrost system with a defrost window used in a vehicle.

Referring to FIG. 8, in use, the vehicle 20 further includes a control system 22, a switch 23, a sensor 24, and an electrical source 25. The control system 22 is electrically connected to the electrical source 25, to control a voltage of the electrical source 25. The electrical source 25 is electrically connected to the defrost window 10 via the first electrode 12 and the second electrode 14, thus a voltage can be applied on the defrost window 10. The switch 23 is electrically connected to the control system 22 and can be controlled by an operator of the vehicle 20. The sensor 24 is electrically connected with the control system 22, and can detect the frost on the defrost window 10. When there is frost on the surface of the defrost window 10, the sensor 24 will send a signal to the control system 22, whereby the control system 22 will control the defrost window 10 to work.

It is to be understood that the application of the defrost window 10 is not limited to vehicles, and can be used in other applications such as building windows or other surfaces which needs frost reduced.

It is to be understood that the above-described embodiments are intended to illustrate rather than limit the present disclosure. Any elements described in accordance with any embodiments is understood that they can be used in addition or substituted in other embodiments. Embodiments can also be used together. Variations may be made to the embodiments without departing from the spirit of the present disclosure. The above-described embodiments illustrate the scope, but do not restrict the scope of the present disclosure.

What is claimed is:

1. A vehicle, comprising:

at least one defrost window, comprising:

a transparent substrate having a top surface;

at least one carbon nanotube film attached on the top surface of the transparent substrate, the at least one carbon nanotube film comprising a plurality of carbon nanotubes;

a plurality of first electrodes and a plurality of second electrodes electrically connected to the at least one carbon nanotube film and spaced from each other, wherein the plurality of carbon nanotubes of the at least one carbon nanotube film is substantially aligned along a direction from the plurality of first electrodes to the plurality of second electrodes, and the plurality of first electrodes and the plurality of second electrodes are extended from vehicle bottom to vehicle top;

a protective layer covering the at least one carbon nanotube film; and an electrical source electrically connected between the plurality of first electrodes and the plurality of second electrodes, the electrical source being adapted to apply electrical currents to the at least one carbon nanotube film;

a control system electrically connected to the electrical source, the control system being adapted to control voltages of the electrical source;

a switch electrically connected to the control system;

a sensor electrically connected to the control system the sensor being adapted to detect frost on the defrost window.

2. The vehicle of claim 1, wherein the plurality of first electrodes and the plurality of second electrodes are arranged in a staggered manner, the plurality of first electrodes are electrically connected with each other, and the plurality of second electrodes are electrically connected with each other.

3. The vehicle of claim 1, wherein the at least one carbon nanotube film is a plurality of carbon nanotube films stacked on each other and disposed on the top surface of the transparent substrate, each of the plurality of carbon nanotube films comprising a plurality of carbon nanotubes combined end to end by Van der Waals attractive force therebetween, and oriented along a same direction.

4. The vehicle of claim 1, wherein the at least one carbon nanotube film comprises a plurality of carbon nanotube segments, the plurality of carbon nanotube segments being successively oriented along a preferred orientation direction of the plurality of carbon nanotube segments and being joined end-to-end along the preferred orientation direction by Van der Waals attractive force therebetween.

5. The vehicle of claim 4, wherein the plurality of carbon nanotube segments comprise a plurality of carbon nanotubes substantially parallel to each other, and combined by Van der Waals attractive force therebetween.

6. The vehicle of claim 1, further comprising an adhesive layer disposed on the top surface of the transparent substrate, between the transparent substrate and the at least one carbon nanotube film.

7. The vehicle of claim 1, wherein the protective layer is made of made of polycarbonate, polymethyl methacrylate acrylic, polyethylene terephthalate, polyether polysulfones, polyvinyl polychloride, benzocyclobutenes, polyesters, acrylic resins, or epoxy resin.

* * * * *